United States Patent [19]

Restrepo

[11] 4,175,868

[45] Nov. 27, 1979

[54] PROCESS FOR INCORPORATING REINFORCING FIBERS IN CEMENTING MATRICES, USING AN APPARATUS COMPRISING VIBRATING TRAYS

[76] Inventor: José M. Restrepo, Calle 85 No. 30 Piso 14-70, Bogota, Colombia

[21] Appl. No.: 903,207

[22] Filed: May 5, 1978

[51] Int. Cl.[2] ..... B28C 5/04

[52] U.S. Cl. ..... 366/9; 366/14

[58] Field of Search ..... 366/9, 14, 15, 31, 32, 366/108, 111, 112, 113, 236, 237, 239, 250

[56] References Cited

U.S. PATENT DOCUMENTS

| | | | |
|---|---|---|---|
| 477,361 | 6/1802 | Gray | 366/9 |
| 670,222 | 3/1901 | Campbell | 366/9 |
| 1,107,237 | 8/1914 | Smith | 366/9 |

FOREIGN PATENT DOCUMENTS

| | | | |
|---|---|---|---|
| 1233760 | 2/1967 | Fed. Rep. of Germany | 366/9 |

*Primary Examiner*—Edward J. McCarthy
*Attorney, Agent, or Firm*—Browdy and Neimark

[57] ABSTRACT

Process for homogeneously incorporating fibrous reinforcing material into a matrix of pastes of cementing materials comprises, withdrawing from a supplying station a stream of cementing material paste containing a proportionate layered amount of segmented fibrous material, wherein the layers of fibrous material are uniform layers alternating with layers of cement paste, gravity flowing said stream under laminar flow conditions along a succession of stream lengths flowing in vertically spaced-apart slopes while the above mentioned laminar-flow stream lengths undergo vibration, free-fall discharging from the downstream end of an upper stream length the cement paste onto the upstream end of a stream length flowing by gravity and under vibration along a next succeeding lower slope, wherein the direction of flow of a successive vertically spaced apart stream lengths is in opposite direction. Each laminar-flow stream length, in thin layer and under vibration, takes place along an inclined tray or channel. The trays may have parallel side walls, or their side walls may uniformly reduce their separation from each other downstream, so that the bottoms of the trays are trapezoidally shaped planes.

9 Claims, 4 Drawing Figures

PROCESS FOR INCORPORATING REINFORCING FIBERS IN CEMENTING MATRICES, USING AN APPARATUS COMPRISING VIBRATING TRAYS

BACKGROUND OF THE INVENTION

As a preparatory step in the manufacturing of fibrocement articles, it is required to prepare a cement paste containing segments of reinforcing fiber uniformly distributed in the paste. The strength properties in a given reinforcing fiber have of course remarkable effect on the end properties of the structures made from the paste of cementing material containing the fiber incorporated therein. The degree of adherence between the paste of cementing material and the individual fibers has also extreme influence on the structure properties. The preservation of the strength properties of the fiber in the process of its incorporation, as well as the adherence degree attainable in the end structure largely depend on the process followed for incorporating the fibers of reinforcing material into the matrix of cementing material pastes.

A method for incorporating segments of fibrous material into a cement paste, in practice at the present, is a mixing process. In this process the components, cement, water, inert filler material and plastizicer agent are placed into a mixer. The suitable mixer may be a rotary drum interiorly fitted with blades arranged so as to agitate the plastic mass, or it may be a container equipped with a mechanical stirrer. An alternative process is pneumatically incorporating the reinforcing fibers into the previously mixed cement paste. In the latter case a paste jet under a substantial pressure, is combined with pneumatic jet containing the fibrous reinforcing material. The union of both of the pressure jets originates the mass comprised of the fibrous material and the cement paste, in a more or less homogeneous condition.

In either of the foregoing processes it is necessary to improve the fluidity of the cement paste by the use of a fluidifying agent. High degree of fluidity will enhance wetting of the fiber by the cement paste; as a result the attainable adherence under these conditions will be good. In order to achieve the desirable degree of fluidity, however, an amount in excess of fluidifying agent is frequently used. Since this excess amount of fluidifying agent adversely affects the fiber reinforcing properties, which tends to offset the enhanced effect on the adherence property obtained as a consequence of improving the initial wetting of the fiber, it is therefore necessary to remove the excess amount of said fluidifying agent from the final paste. This is a cumbersome removal operation which is carried out with substantial difficulty, and in addition, it is of effect on the cost of the process for incorporating reinforcing fibrous material into the cement paste.

In either of the aforecited prior art processes, the fibrous segments are subjected to impact or to an excess of friction, to a greater or lesser extent. If a fracture is initiated in the fiber or if fiber is actually broken, then as a result, the possibility of completely using the full fiber strength is decreased. The fracture frequently shortens the fiber length to such an extent where is not long enough so that, through the physical adherence between the cement matrix and the fiber, the fiber can not be stressed up to the limit of its stress capacity. This is so because the stress that can be developed in a fiber is directly proportional to the fiber length which is adhered to the stress-transmitting matrix. As a consequence, it is desirable to have a process for incorporating fibrous segments into the cement paste, wherein the original physical properties that the fiber had before its incorporation, be as far as possible preserved in the final paste.

Furthermore, the adherence that ultimately may be attained between the cementing material matrix and the fibrous material segments is affected by the degree of fiber opening. Cement-mass reinforcing fibers, either natural or man-made fibers, are often in multifilamentary strands. In the strand condition, a great number of filaments fail to be suitably wetted by the cement paste because they are so packed together that the paste cannot enter the filamentary strand. It is therefore important that the process for incorporating fibrous material into the cement paste brings about a suitable degree of opening of the fibrous strand or spreading out of the individual filaments, and this is to be done under conditions not originating fiber breakage. Further, normally the fibrous strands have been treated with binders or size. In this respect, the mixing process for incorporation of fibers into the cement paste, allows suitable fiber opening, unless the fibers used have strong binders. In any case, however, there is the danger of fiber breakage, even without opening. As far as the process using pneumatic means for incorporating fibrous material into cement paste is concerned, this process does not facilitate to a substantial extent the fiber strand opening; it only induces incipient opening of the fibers, if weak binders are used. This in addition accounts for the fact that, when this process for incorporating fibers is used, the adherence of fibers to the cementing matrix, is more or less poor.

Finally, an excessive amount of entrained air into the cement paste, impairs the adherence between fibers and matrix, and as a result the reinforcing properties are also adversely affected. In the process of incorporation of fiber by mixing operation, a great amount of air is left occluded into the cementing matrix since, in the process conditions, no particular means are provided permitting the air to migrate to the mass surface. For the air bubbles to reach the surface, they would have to travel substantial distances. In consequence a great number of air bubbles remain entrained between fibers and cement paste, which remarkably decreases the adherence between the fibers and the mass. With regard to the process using pneumatic means for incorporating segmented-fibrous material into the cement paste, part of the air used for forming both the paste jet and the fiber jet, is left entrained in the final mass. The result is an end mass having a great amount of air. This additionally accounts for the decreased adherence achieved by means of this process, and consequently, the use of the fiber is poor, and its reinforcing action is greatly diminished.

SUMMARY OF THE INVENTION

An object of the present invention is to provide a process for homogeneously incorporating fiber reinforcing material into matrices of cementing paste materials, according to which, the incorporated individual fibers preserve to a high degree the physical properties they had before their incorporation into the cement paste. Thus, the fibers are capable of transmitting to the end matrix their tensile strength properties in the best attainable degree.

Another object of the invention is to provide a process of the above stated nature, which permits the incorporation of fibers into relatively stiff cement pastes without the need of any excess amount of fluidifying agent. Therefore, in the absence of an excess of fluidifying agent, that it would be necessary to remove, improved adherence of the fiber to its matrix is obtained, and the uniformity of the density throughout the cement paste is improved as well, consequently enhancing the final structure strength.

An additional object of the present invention is to provide a process for incorporating fibers into a cement paste, wherein the fibers are not subjected to serious impact or friction.

Still, another object of the invention is to provide a process allowing for full opening of fibrous strands into filaments, including the binder-treated fibers or fibers with size. In this way the contact between the fiber filaments and the cement paste is enhanced.

Another additional object of the present invention is to provide a process of the stated nature, which provides means for expelling the greatest extent the occluded air. As a consequence the fiber surfaces are intimately contacted, without interfering air, by the cement paste.

Yet another object of the invention is to provide the apparatus for carrying out the process for homogeneously incorporating the fiber reinforcing material into cement pastes.

The foregoing and other objects and advantages of the invention will be apparent from the following description of the process according to the invention.

The invention contemplates a process and apparatus for homogeneously incorporating reinforcing fiber material into cement pastes. The process comprises, originating, by gravity and under conditions of laminar flow, a thin-layer stream which flows down in a number of vertically spaced-apart successive lengths, there being between consecutive vertically spaced lengths a free fall space, while the stream flowing in each length is subjected to vibration. The direction of flow of each laminar-flow stream length, is reversed after each free-fall step.

The vibration imparted to each stream length flowing as a thin layer, originates a general effect of compacting action of the cement paste with the fiber, such effect enhances the adherence. Likewise, the vibration applied to the thin layer kept in laminar flow permits to handle mixtures without excess of fluidifying agents, and both the migration of air bubbles to the surface and the rearrangement of grains of inert filler material and segments of reinforcing fibers, is assisted, as well as the fiber opening, this without subjecting the fibers to breaking stresses. As a consequence, according to the process of the invention, a greatly dense end mass is obtained, having improved fiber adherence. Therefore, the structures made from the mass so prepared will present enhanced strength and impermeability properties. The effect of non open and deficiently ahered fibers is to originate capillarity in the structure because of the voids between filaments. It must be noted that the process of the invention minimizes the occurrence of capillarity.

Furthermore, since it is maintained a thin layer stream flowing in laminar flow under conditions of vibration, the complete mass, together with the fibrous material, is subjected to the same conditions of treatment. As a result from the above, the final mass is thoroughly homogeneous, with regard to both, the distribution and aherence of fibers throughout the end mass. Therefore, the manufactured structures will exhibit both tensile and flexural improved strength, and a high degree of impermeability, the foregoing in contradistinction to the processes where the components are subjected to turbulent flow.

In addition, when inverting the direction of flow of the paste stream, under the aforecite conditions, according to the process of this invention, after each free fall step, the layer flowing in laminar flow is overturned, that is, the relative positions of the bottom and top films of the layer are inverted, so that the top film of the layer flowing in an upper run will adopt the bottom position in the next succeeding run. This overturning effect is repeated along the entire paste stream, so that at the end of its complete travel the stream will have been interfolded several times.

As a result of the overturning effect, if in a given upper stream length the fibers had been submerged into the layer under the vibrating action, in the next succeeding stream length, after the free fall step the fibers will appear atop the layer, and then here again they will be submerged in like manner. But if the fibers in a given upper stream length tend to float, then in the next succeeding stream length such fibers will go to the underside position; if the tendence to float still persist, the fibers to do so must travel through the thickness of the flowing layer.

In this manner the fibers are caused to repeatedly run short paths through the mass, that is, they are moved back and forth across the thickness of the mass stream while permitting the occluded air to be released.

From the foregoing it will be noted that all the fibers in the mass are subjected to the same amount of vibration, and that they will be given the same opportunities to open, release the air occluded therein and to become wet through short migrations in the mass. It is apparent that the above chances do not exist when a static mass of cement paste and segmented fibrous material is vibrated, since vibrations alone do not originate migrations of particles per se, but instead simultaneous oscillatory movements on each of the particles, is brought about. In addition, in a static mass the air bubbles would have to run relatively long lengths in order to migrate to the surface, an effect that is rather difficult to accomplish.

Fibrous reinforcing materials contemplated for use in the present invention are asbestos, alkaline-resistant glass, steel, carbon, polypropilene, nylon, and cellulose fibers.

As hereinabove stated, the apparatus comprises a supporting rigid, vertical tower-like structure, rectangular in cross-section. To the tower structure there are hingedly connected a number of frames which are located vertically spaced apart along the height of the tower structure, and where on each of the frames there is supported a respective tray or channel to conduct therealong respective stream lengths in laminar flow. The sloping channels are provided with bottom planes which may be rectangular or trapezoidal in shape. Where a combination of the above trays is used, the trapezoidal-bottom channels are arranged at the lower section of the structure, and at a slant that the minor base is the lower edge or the fall end of the stream.

In order to generate a gravity laminar-flow stream, the trays of the vertical series have their bottom planes adjustable in slope. The slope can by changed depending on the characteristics of the particular paste of the cementing material to be processed. The general arrangement of separate trays along the tower height is such that the slopes of successive trays are opposed to each other.

It is also comprised within the scope of the present invention to use two sets of trays, each set having the slopes of their trays perpendicular, when viewed in plane view, to the slopes of the trays of the other set. Having those sets either rectangular or trapezoidal trays or a combination of both types.

When using trapezoidal-bottom trays only, or a combination of trays, the trapezoidal tray located first up in the vertical series is the larger one, and the size for the lower trays progressively decreases when going down in the tower.

The frames supporting the trays are associated to vibration generating means, so that the trays are vibrated when the cementing material paste flows therealong. The vibration may be changed, in both amplitude and frequency, depending on particular characteristics of the paste to be processed.

The delivering station is comprised of a tray arranged at the top of the tower and from which the recently proportionate material is fed. At the lower part of the tower it is provided a hopper for collecting the processed material or end mass with the fiber properly incorporated thereinto.

In order to provide a more thorough description of the invention, this will be hereinafter described in connection with the accompanying drawings in which by way of non limitative example, a preferred embodiment of the invention is shown.

DESCRIPTION OF THE PREFERRED EMBODIMENT

Figure 1:
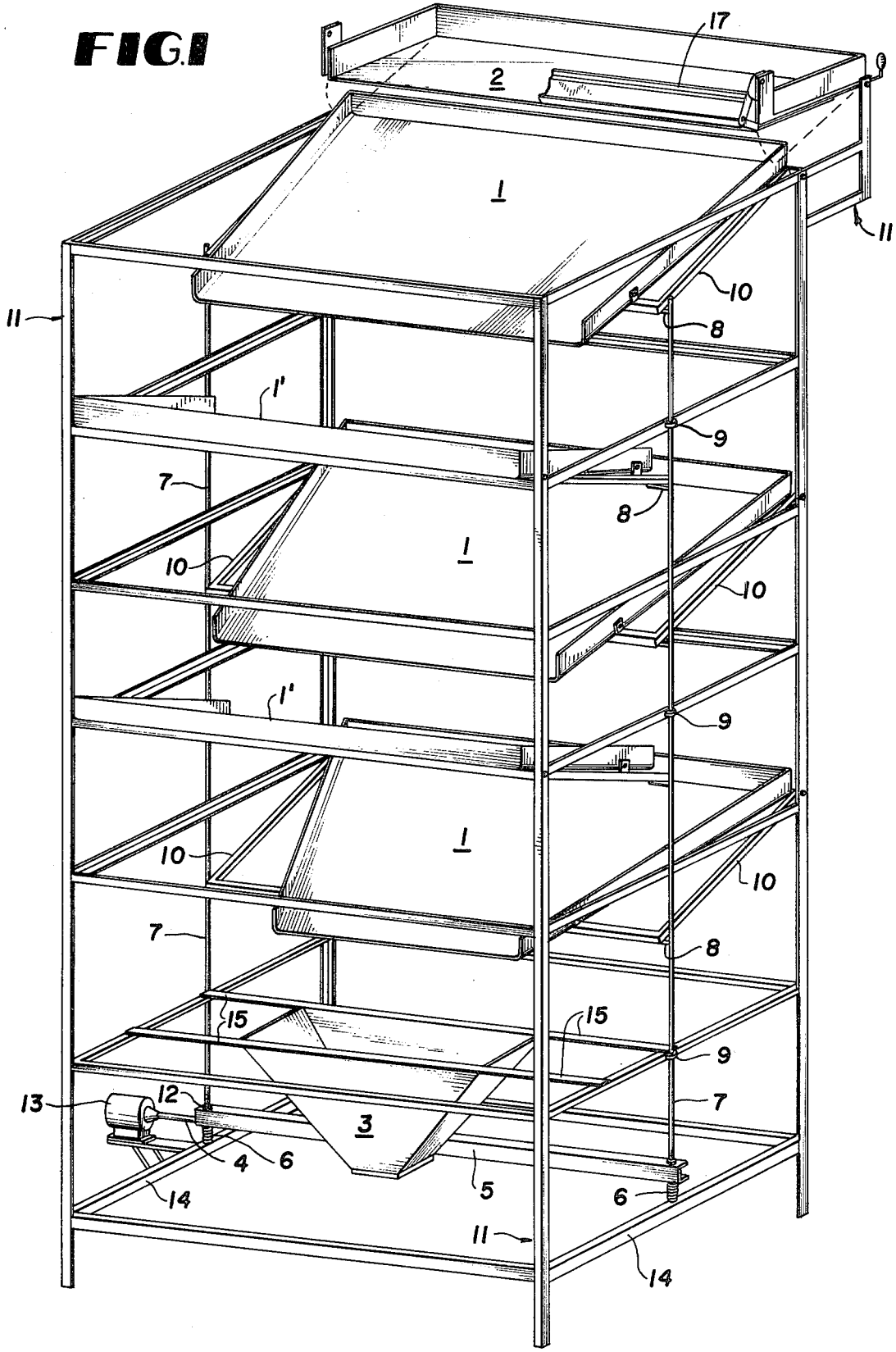
FIG. 1 is a perspective view of the apparatus for carrying out the process of the invention.
Figure 2:
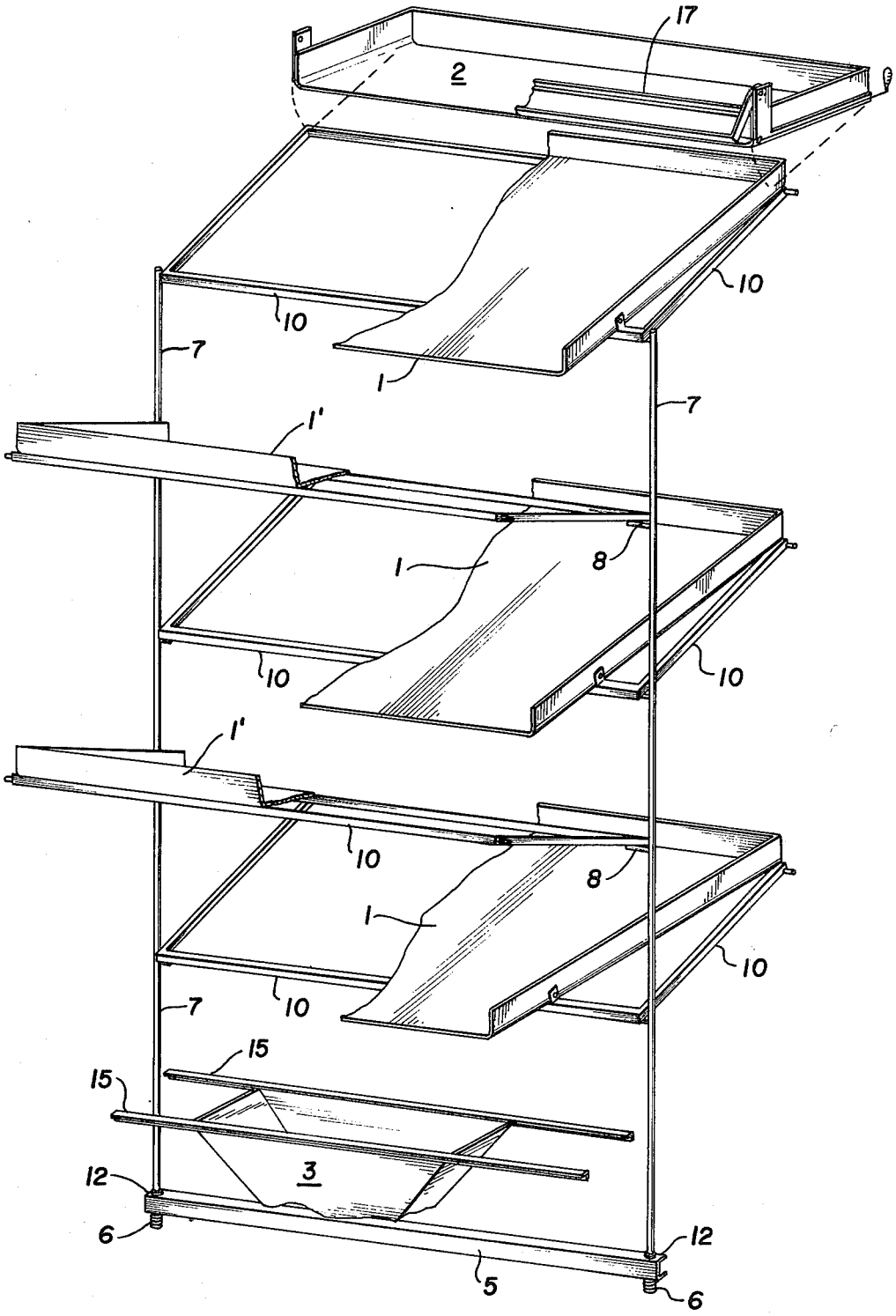
FIG. 2 is a perspective view of the apparatus of FIG. 1 with parts of the structure removed, and with parts of the trays broken away.
Figure 3:
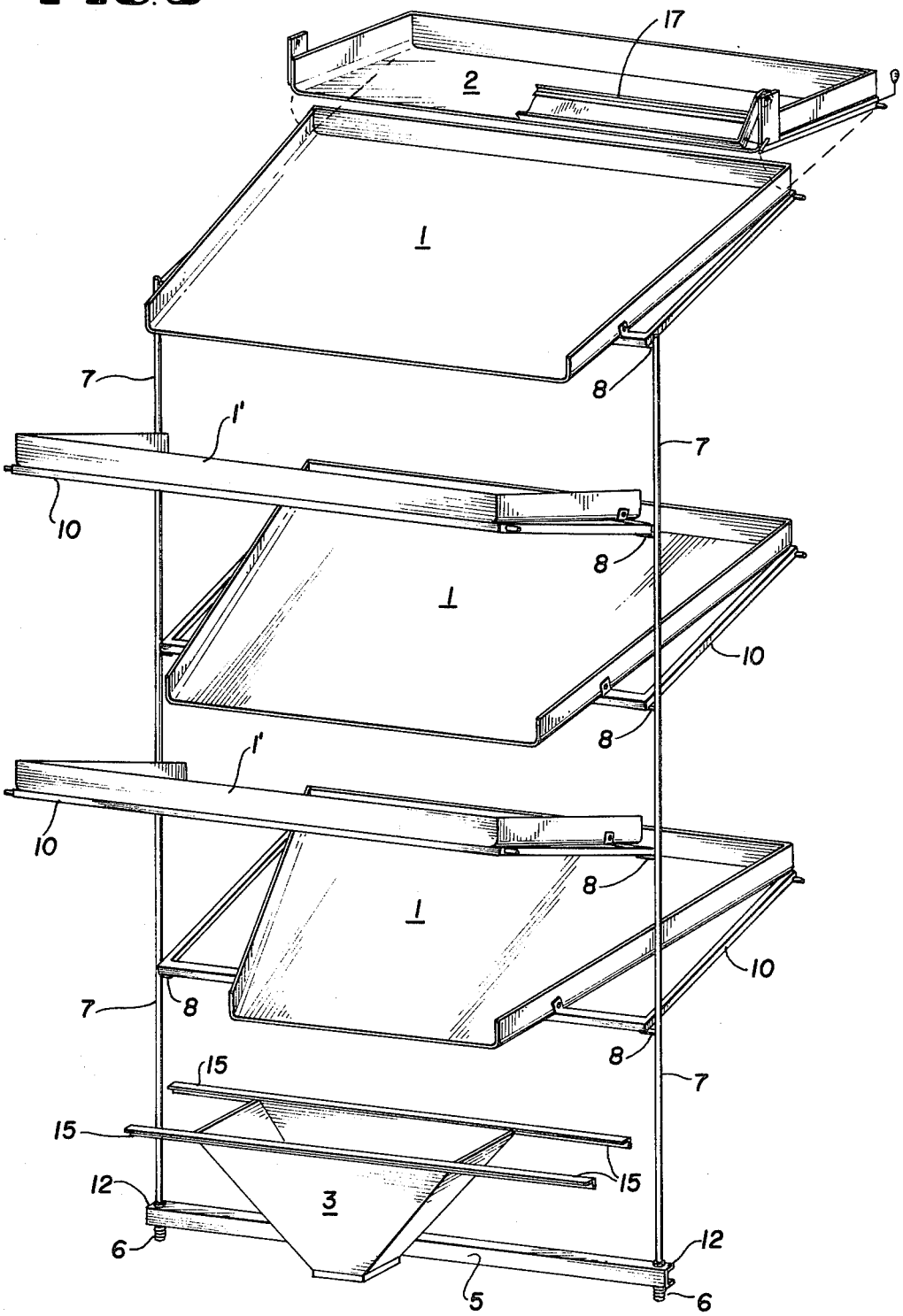
FIG. 3 is a perspective view with part of the structure removed for the purpose of clearly illustrating the relationship between trays.

Referring to the drawings, with the numeral of reference 11 in FIG. 1, it is shown in general the vertical structure or supporting tower. The supporting structure 11 comprises vertical members joined together by means of transverse elements for forming an structure of rectangular cross section. At the tower top there is the supplying station formed by an horizontal tray provided with a pouring slot formed by a pivoting gate 17, suitable to pour down the cementing material paste containing a proportionate layered amount of segmented fibrous material wherein the layers of fibrous material are horizontal uniform layers alternating with horizontal layers of cementing material. The tray 2 may be charged, either manually or mechanically if so is desired, with horizontal strata of cement pase and horizontal strata of fibrous material, in an alternating stack.

Below the supplying station 2 there are arranged, along the height of the tower, a series of frames 10. The frames 10 are hingedly connected to the tower structure 11 at locations vertically spaced apart, so that the frames 10 can swing on pivot pins by means of which they are attached to the vertical members of the tower 11. The setting of frames 10 in respect to the structure 11 is such that their planes are inclined from the tower cross-section, and where the slopes of next succeeding frames are opposed each other.

Two vertical rods 7 are freely connected in vertically sliding relationship to the vertical structure 11, each of the rods 7 being located at each opposite vertical side of the structure. The vertical rods 7 have their lower ends adjustably joined to the ends of a cross-piece 5 which in turn has its ends resilently supported on coil springs 6 bearing on respective cross members 14 of the rigid structure 11, as it is shown in FIG. 1.

The vertical rods 7 are freely connected in vertically sliding relationship to the structure 11 by passing them through vertically aligned passages formed by clamps 9 fixedly attached to cross members of the structure 11. The vertical rods are provided with spaced apart spikes 8 horizontally extending therefrom towards the center of the structure. The spikes 8 are so spaced along the length of the rods 7 as to support the outer marginal lower ends of the sloping frames 10 which, as mentioned above, are swingingly connected to the vertical structure 11, at points near their raised ends.

The trays 1 and 1' are supported on sloping frames 10 so that vertically consecutive trays 1 and 1' are inclined in opposed directions. As stated above, the trays or channels have bottom of either rectangular or trapezoidal shape. However, it can be arranged in the tower 11 a series of trays where the trays placed higher in the series are of rectangular bottom whereas the lower ones in the series have bottom of trapezoidal shape. The size of the trays decreases as they are lower in the series; the dimensions of both, the major and minor bases of the trapezoidal-bottom trays, progressively decrease as they are located lower in the tower. Following the lowermost tray of the series, the vertical structure 11 is provided with a hopper 3 suitably associated to the structure, such as by means of cross-bars 15, or the like.

With the just described arrangement, from the delivering tray 2, provided at the top of the structure 11, it is withdrawn a stream of supply material, containing horizontal layers of cement paste alternating with uniform layers of segmented fibrous reinforcing material in the proper ratio, which is caused to flow as a first stream length along a first sloping tray 1, in a thin layer, by gravity and under conditions of laminar flow. Thereafter the stream of material continues to flow in like manner as a succession of stream lengths on the series of opposedly sloping trays 1 and 1'. Each above mentioned stream length in a thin layer is subjected to vibration, which is applied from the vibrator 4 through the cross member 5, which in turn causes the vertical rods 7 to vibratorily reciprocate against the force of the coil springs 6. The spikes 8, on which the frames 10 bear are thus vibrated together with the trays 1, 1' supported thereon.

The application of vibration to the stream length in thin layer of cement paste containing fibrous segments, determines that the mixture becomes suitably fluid, because of its thixotropic structure. That is, it behaves like a fluid while is shaken but if left undisturbed it sets to a gel-like structure. The fluidified thin layer of cement paste, kept in laminar flow conditions and under the effect of vibration, help the release of air, both the air entrained in the cement paste and the air occluded in the fibers, and likewise the suitable fibers opening is assisted which in turn causes their thorough wetting, required to improve the adherence between the mass and the fibers.

It will be noted then that, as a result of the vibratory effect kept on the stream lengths flowing along the trays 1 and 1', under laminar flow conditions, it becomes possible to handle mixtures without using an excess amount of fluidifying agent. It will be noted further that the incorporation of the fiber into the mass takes place by the movility that under vibration the fibers have into the fluidified mass, thus avoiding fiber abrasion or fiber breakage in the fiber incorporation process.

Figure 4:
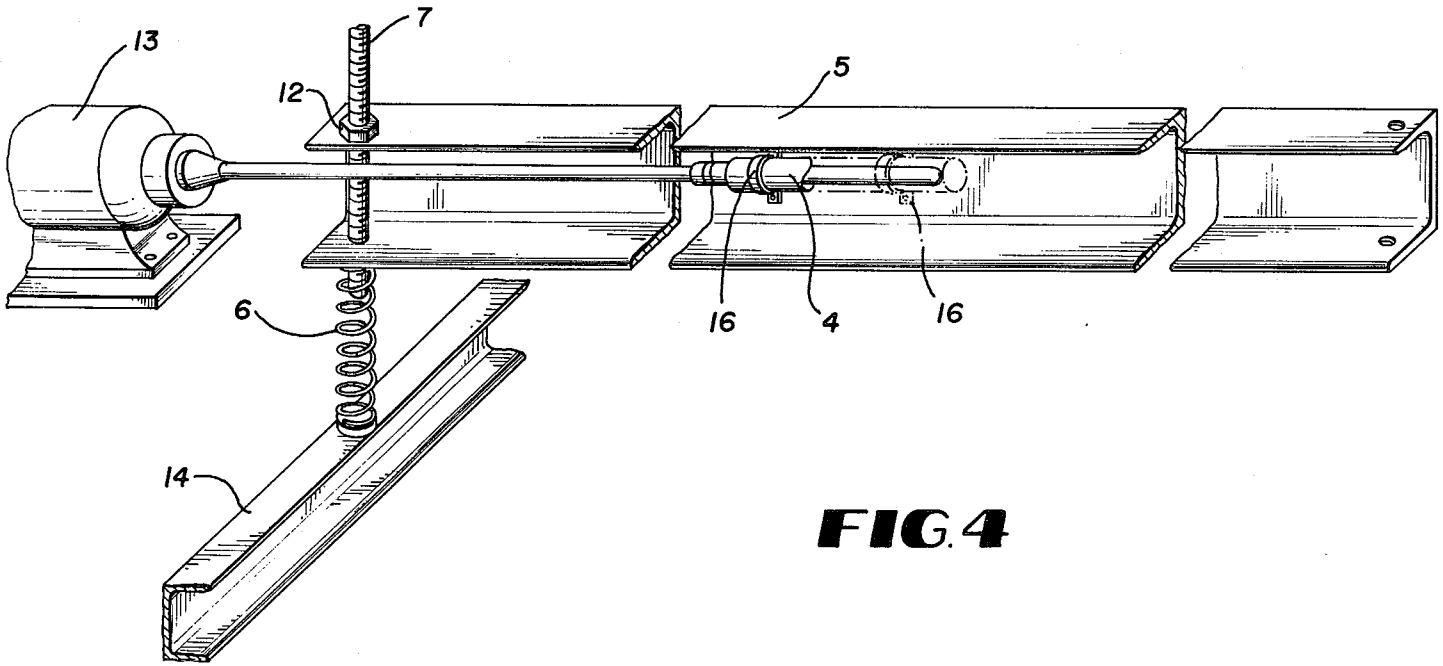
FIG. 4 is a detailed perspective view showing the vibrating means.

Since different mixtures have different characteristics depending on the particular kind of cement elected, its amount in the mixture, on the quantity, quality and size distribution of the fine aggregates used, etc., the apparatus may be adjusted as to handle different kinds of mixtures, according to the process of the invention. The laminar-flow stream taking place along a given tray may be controlled by changing the particular tray slope, by any suitable means. The tray slope may be varied for instance, by changing the height to which the spike 8—on which the frame 10 is supported—is attached to the vertical rod 7, which is facilitated because the frame 10 is pivotally connected by its raised end to the structure 11. By means of the setting of the nut 12 (FIG. 4) to a higher or lower height around the threaded lower end of the vertical rods 7, the slope of the frames 10 supported on the spikes 8, can correspondently be changed.

The vibratory head 4 is attached to the bridge 5 by means of clamps 16 which may be tightened to greater or lesser degree against the bridge 5; in this manner it is possible to regulate the amplitude of the oscillations of the set of trays.

A control of the frequency of the applied vibrations is attained by acting on the rotating speed of the motor 13. The motor and the devices for controlling the motor velocity as well as the vibratory head may be chosen from a number of devices commercially available.

Finally, it will be noted that, since the frames 10 are hingedly connected to the rigid structure 11, they will receive the vibratory movement communicated through the vertical rods 7, substantially without imparting vibration to the rigid structure 11. Therefore, the frames 10 will freely vibrate, without receiving vibration from the rigid structure 11, which otherwise would originate vibration overlapping and eventually their cancellation.

It will be noted from the foregoing description that a process for homogeneously incorporating fibrous reinforcing material into a matrix of cementing material pastes, and the apparatus for carrying out the same, which meet the above mentioned objects, have been disclosed. Further, it should be understood, however, that it is not intended that the invention be limited to the described details in connection with the specifically disclosed embodiment; it is intended that its equivalents obvious for those skilled in the art will be comprised within the scope of the invention as taught in the preceding specification and as it is defined in the following claims.

I claim:

1. A process for homogeneously incorporating fibrous reinforcing material into a matrix of pastes of cementing materials, comprising, charging in alternating relationship into a supplying station horizontal strata of cementing material paste and horizontal uniform strata of fibrous material;

withdrawing from said supplying station a stream of cementing material paste containing a proportionate layered amount of fibrous reinforcing material;

gravity flowing under laminar flow conditions said stream along a succession of stream lengths, with each of the stream lengths flowing on respective vertically spaced apart slopes;

free-fall discharging each upper stream length from its downstream end onto the upstream end of the next succeeding stream length flowing along a corresponding lower slope;

reversing the direction of flow of each of said stream length of said succession, following each free fall discharge; and collecting cementing material paste having fibrous reinforcing material homogeneously incorporated therein, at the end of said succession of stream lengths; wherein said stream of cementing material paste containing fibrous material is caused to flow along said succession of stream lengths in the condition of thin layer, while each of said layers is subjected to vibration.

2. A process as claimed in claim 1, wherein said fibrous reinforcing material is in the form of segmented fibers.

3. Process as claimed in claim 1, wherein said fibrous reinforcing material is selected from the group consisting of asbestos, alkaline-resistant glass, steel, carbon, polypropylene, nylon, and cellulose fibers.

4. Apparatus for homogeneously incorporating segmented fibrous reinforcing materials into a matrix of cementing material pastes, comprising, a rectangular cross-section vertical structure having arranged at its top end a supplying station for feeding cementing material paste containing fibrous reinforcing material therein;

a plurality of frames swingingly connected to said vertical structure at spaced apart positions along the height thereof, and beneath said supplying station, with said frames being directed along inclined planes, and with successive inclined planes sloping in opposite directions;

a corresponding number of trays with each of the trays being supported on one respective frame of said plurality of frames arranged in inclined planes, so that the tray bottom planes of consecutive trays slope in opposite directions;

vibration generating means associated to said vertical structure arranged to apply vibration to each of said frames, whereby the trays supported thereon are vibrated; and means arranged at the lower part of said vertical structure for collecting cementing material paste having fibrous reinforcing material homogeneously incorporated therein.

5. Apparatus as claimed in claim 4, wherein the sloping bottom of said trays is trapezoidal in shape with their minor bases at the lower end of the slope.

6. Apparatus as claimed in claim 5, wherein the dimensions of both the major and minor bases of the trapezoidal-bottom trays progressively decrease as they are located lower in the vertical structure.

7. Apparatus as claimed in claim 4, where said plurality of trays comprises a series of sloping rectangular-bottom trays swingingly connected to an upper section of said vertical structure, and a series of sloping trapezoidal-bottom trays swingingly connected lower in the vertical structure.

8. A process according to claim 1, comprising, gravity flowing said stream along an upper first series of vertically spaced apart sloping trays wherein the direction of flow is reversed on successive trays;

discharging said stream from the bottom of said first series of trays into hopper-like means which has its lower end in the form of a slot at right angles in the horizontal plane, with the upper face of the hopper;

gravity flowing said stream from said hopper means onto the top tray of a lower second series of vertically spaced apart sloping trays wherein the direction of flow is reversed onto successive trays, and where said reversing direction of flow is perpendicular to the reversing direction of flow effected in said upper first series of sloping trays; and collecting from the lowermost tray of the lower series of trays, connecting material paste having fibrous reinforcing material homogeneously incorporated therein.

9. A process for homogeneously incorporating materials together, of the class in which the materials are layer-like gathered in a supplying station from which the materials are allowed to run along a succession of downwardly tapering channel-like sections oppositely inclined and spaced apart one below the other, characterized in that it comprises the steps of:

charging in alternating relationship into said supplying station horizontal strata of a forming-matrix premixed paste of cementing material and horizontal uniform strata of a fibrous material in the form of segmented fibers;

withdrawing from said supplying station a stream of said cementing material paste containing a proportionate layered amount of fibrous reinforcing material in the form of segmented fibers;

gravity flowing under laminar flow conditions said stream along a succession of stream lengths, with each of said stream lengths flowing in thin layers on respective spaced apart slopes, while each of said thin layers is independently subjected to vibrating action;

free-fall dicharging each upper stream length from its downstream end onto the upstream end of the next succeeding stream length flowing along a corresponding lower slope;

reversing the direction of flow of each of said stream lengths of said succession, following each free fall discharge; and collecting cementing material paste having fibrous reinforced material in the form of segmented fibers homogeneously incorporated therein, at the end of said succession of stream lengths.

* * * * *